United States Patent [19]

Picon

[11] Patent Number: 4,860,178

[45] Date of Patent: Aug. 22, 1989

[54] TOILET BOWL LIGHT

[76] Inventor: Joseph Picon, RD #1, Box 519, Henry St., Jackson, N.J. 08527

[21] Appl. No.: 167,492

[22] Filed: Mar. 14, 1988

[51] Int. Cl.[4] ..... F21V 33/00

[52] U.S. Cl. ..... 362/101; 362/154; 362/253; 362/802; 4/661

[58] Field of Search ..... 362/101, 154, 155, 253, 362/457, 458, 802, 276, 190, 191; 4/661, DIG. 6

[56] References Cited

U.S. PATENT DOCUMENTS

| | | | |
|---|---|---|---|
| 2,548,019 | 1/1949 | Niles | 362/101 |
| 2,947,850 | 8/1960 | Reilly | 362/154 |
| 4,413,364 | 11/1983 | Bittaker et al. | 4/DIG. 6 |
| 4,491,991 | 1/1985 | Herbruck | 4/661 |
| 4,736,471 | 4/1988 | Johnson | 4/661 |

*Primary Examiner*—Ira S. Lazarus
*Assistant Examiner*—D. M. Cox
*Attorney, Agent, or Firm*—Clifford G. Frayne

[57] ABSTRACT

A toilet bowl lighting means comprising an L-shaped body having a light means and a power source means in communication with the light means, the L-shaped body means attached to the underside of a toilet seat positioning the light means on the interior of the toilet bowl, the toilet bowl lighting means having an automatic and manual switching means.

1 Claim, 3 Drawing Sheets

FIG. 5
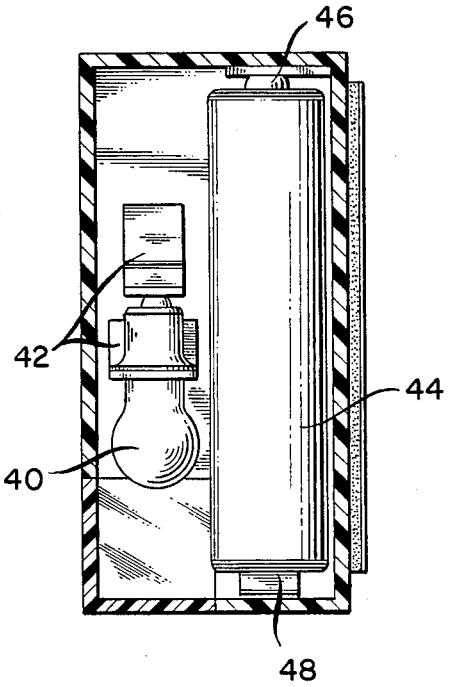
FIG. 6
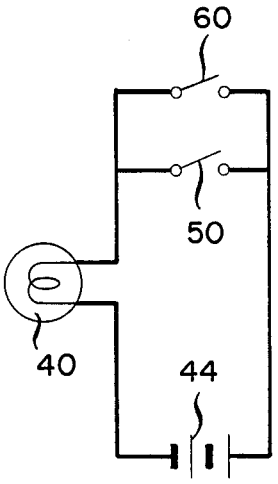
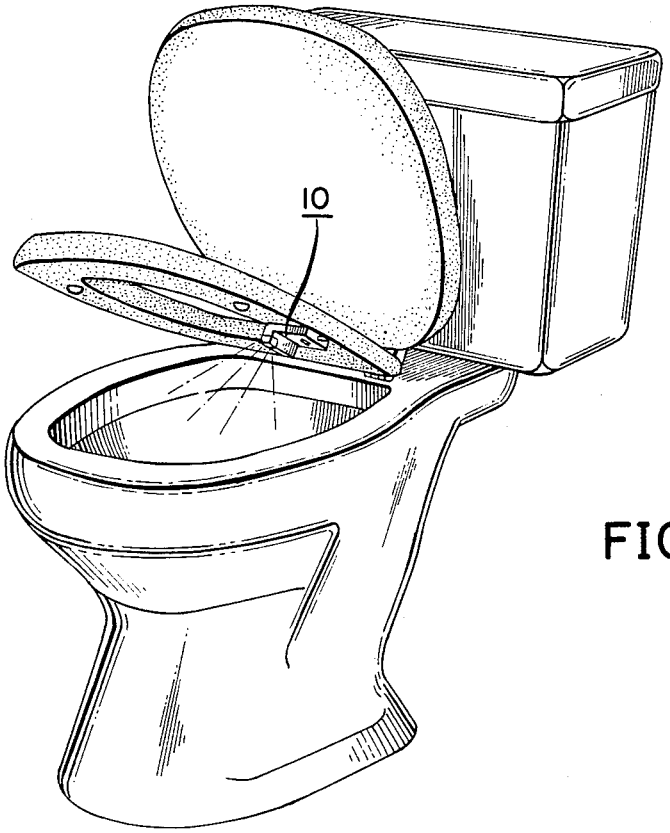
FIG. 7

TOILET BOWL LIGHT

FIELD OF INVENTION

The present invention relates to a lighting means and, in particular, to a lighting means for lighting a toilet bowl without the necessity of activating the room lights.

BACKGROUND OF THE INVENTION

The present invention relates to the lighting of the inside of a toilet bowl without the necessity of activating the overhead room lights by means of a wall switch or other switching means.

Adults which require the need to utilize a toilet bowl in the evening hours or the middle of the night when there is no direct sunlight often find that the switching on of the direct overhead lights irritates the eyes and causes temporary disorientation. Additionally, adults with small children, the children who are incapable of reaching the wall switch, often find that they are awakened in the middle of the night by the child in order to accompany the child to the toilet because of the child's inability to reach the wall light.

The present invention provides a novel toilet bowl light which is operable when the toilet seat is either in the down position or the up position and which provides sufficient light to illuminate the toilet bowl for an adult or a child such that the overhead incandescent or fluorescent lights are not required. As such, this device aids in keeping the toilet bowl and surrounding area sanitary and allows for the uninteruppted sleep by an adult with children or the ability of the adult to utilize the bathroom without the unnecessary irritant of being subjected to direct, intense artificial light.

OBJECTS OF THE INVENTION

An object of the present invention is to provide a novel toilet light which is easily fitted between the underside of the toilet seat and the toilet bowl.

Another object of the present invention is to provide a novel toilet light which is operable with the toilet bowl either in an up position or a down position.

A still further object of the present invention is to provide a novel toilet light which a toilet trained child may operate.

A still further object of the present invention is to provide a novel toilet light which provides sufficient light for illuminating the toilet bowl without the need for utilizing the incandescent or fluorescent light of the bathroom ceiling or wall lights.

SUMMARY OF THE INVENTION

A toilet bowl light comprising a body means which encloses a light means attached to a removable power source, the power source and light bulb in electrical connection by means of a switching means for illuminating the inside of a toilet bowl whether the toilet seat is in the horizontal or vertical position, the body means being of such a configuration that it is secured to the underside of the toilet seat without interfering with the toilet seat, toilet bowl engagement when the toilet seat is in the horizontal position.

BRIEF DESCRIPTION OF THE DRAWINGS

A better understanding of the present invention as well as other objects and advantages thereof will become apparent upon consideration of the detailed disclosures thereof especially when taken with the accompanying drawings wherein:

FIG. 5 is an end elevational cutaway view of the toilet light.

FIG. 6 is an electrical schematic of the toilet light.

FIG. 7 is a perspective cutaway view of the toilet light positioned in cooperation with a toilet seat and toilet bowl.

DETAILED DESCRIPTION OF THE DRAWINGS

Figure 1:
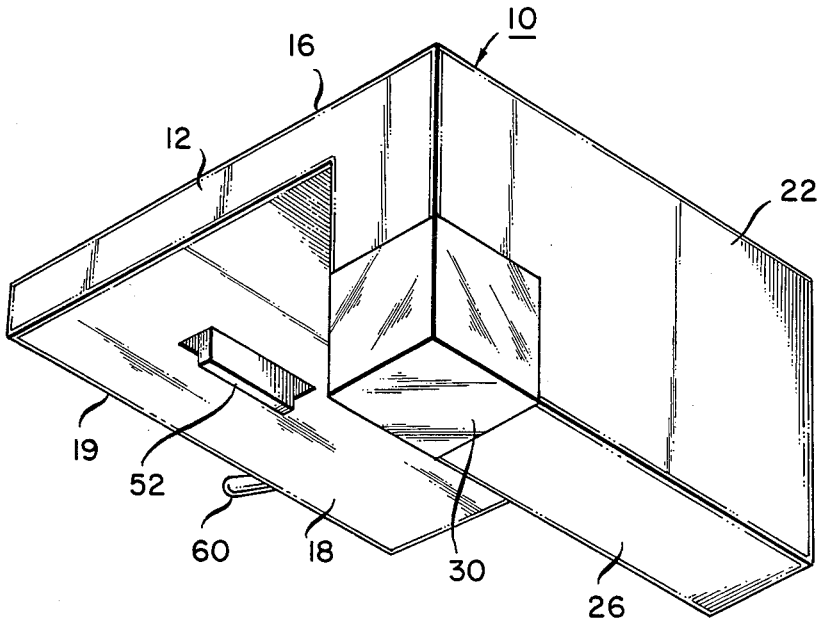
FIG. 1 is a bottom perspective view of the toilet light.
Figure 2:
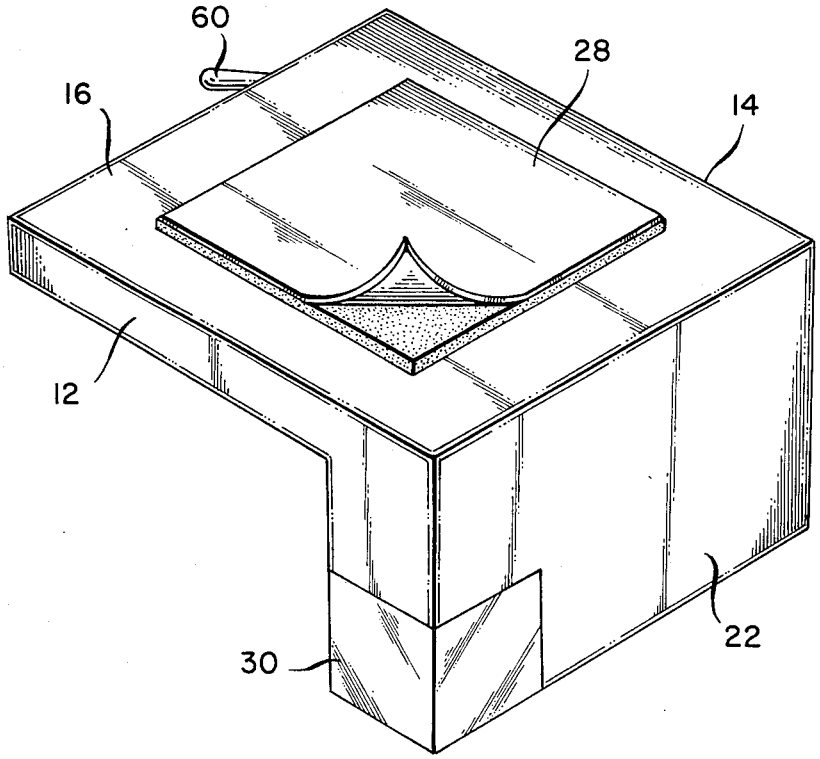
FIG. 2 is a top perspective view of the toilet light.

Referring to FIG. 1, there is shown a bottom perspective view of the toilet light 10 which is the subject matter of the present disclosure. Toilet light 10 is basically L-shaped in side cross sectional area having L-shaped sidewalls 12 and 14. L-shaped sidewalls 12 and 14 define a planar leg bounded by upper planer surface 16, lower planer surface 18 and end wall 19. L-shaped sidewalls 12 and 14 also define a vertical planer leg defined by outer end surface 22, inner end surface 24, and lower planer surface 26. Referring to FIG. 2, it can be seen that upper planar surface 16 has a adhesive tab 28 secured thereto which affixes the toilet light to the underside of a toilet seat as will be more fully explained hereafter. In the configuration shown in FIGS. 1 and 2, the toilet light is comprises of an opaque material with at least a portion of the downwardly depending leg having a transluscent material 30, to permit the passage of light as will be more fully explained hereafter.

Figure 3:
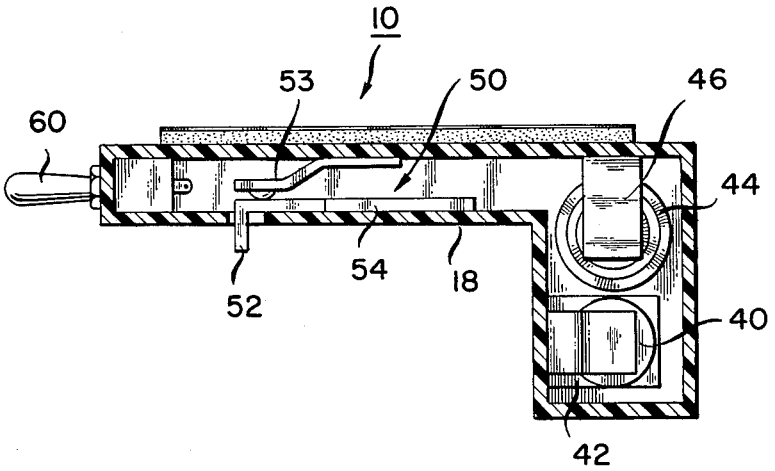
FIG. 3 is a side elevational cutaway view of the toilet light.
Figure 4:
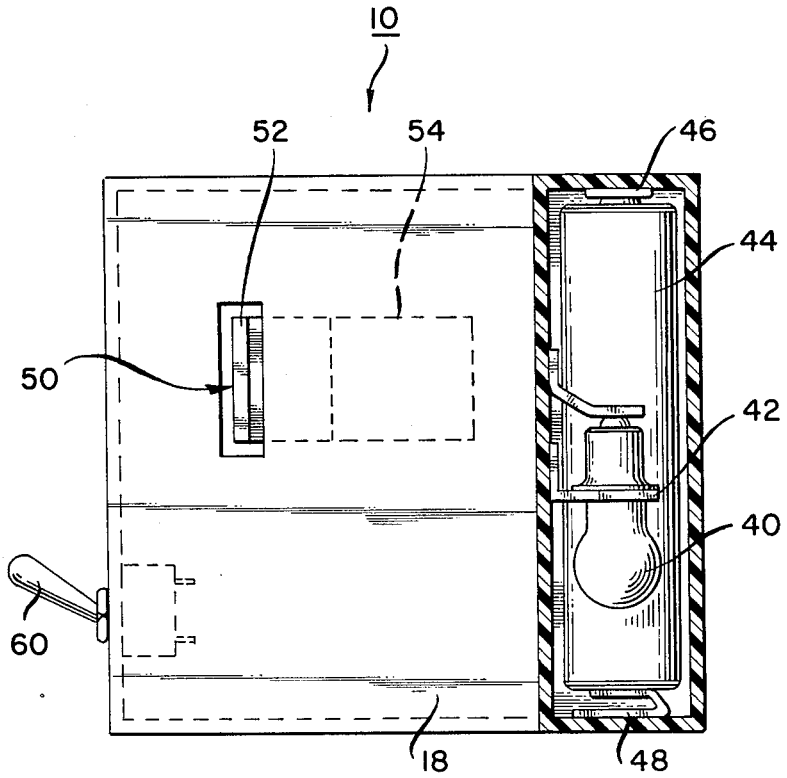
FIG. 4 is a bottom planer view of the toilet light.

Referring to FIG. 3, there is shown a cross sectional cutaway side view of toilet light 10. FIG. 4 discloses a cross sectional planer bottom view of toilet light 10 and FIG. 5 a cross sectional end view of toilet light 10. There is positioned in the vertical leg of toilet light 10, a light means 40 mounted on a conductive bracket 42. Conductive bracket 42 is electrically connected to power source 44, and in this case, a AA 1.5 volt battery having a positive end conductor 46 and a negative end conductor 48. Light means 40 is positioned in the lower portion of the vertical leg of toilet light 10 such that the light means is proximate to the transluscent material 30 of the vertical leg. The power source 44, is mounted in the upper portion of the vertical leg of toilet light 10. The power source 44 is connected to the light means 40 by means of a circuit as shown in FIG. 6. The circuit comprises an automatic switching means 50 and a manual toggle switching means 60. The automatic switching means 50 comprises a depressable contact switch 52 which depends downwardly through an opening in lower planer surface 18. Lower planer surface 18 is designed to be in close proximation with the toilet bowl when the toilet seat is in a down position such that the toilet bowl would depress switch 52 against spring 53 disengaging contact with contact means 54 which would interrupt the circuit causing no illumination of light means 40. When the toilet seat was raised to an upright position, switch 52 would not be depressed and spring 53 would cause switch 52 to engage contact 54 causing illumination of light means 40. In this configuration, the illumination of light means 40 would automatically occur when the seat is raised.

Manual toggle switch 60 is in parallel electrical connection with power source 44 and light means 40. This permits the operator to activate the switch and provide illumination means when the toilet seat is in a down position if desired or to deactivate the circuit and prevent the illumination of lighting means 40 when the seat is in a down position. The distance of horizontal planar leg of toilet light 10 is such that when the toilet light is connected to the underside of the toilet seat by means of adhesive strip 28, toggle switch 60 is operable since it extends outwardly from the toilet seat. The vertical depending leg of toilet light 10 is positioned such that its inner wall 24 would be in proximate contact with the interior rim of the toilet bowl and lower planer surface 18 would be in proximate contact with the horizontal rim of the toilet bowl so as to provide the activation of switching means 50.

The design and dimensions of toilet light 10 are such so as to permit it to be positioned on the underside of the toilet seat as shown in FIG. 7, such that it can be positioned within easy reach of the user.

Toilet light 10 is designed to fit between the toilet bowl and the underside of the toilet seat along the perimeter of the toilet seat such that it can be easily manipulated by the user. Further, by positioning as such, it is at a convenient height which permits its use by young children if desired. Further, the automatic feature of the light going on automatically when the toilet seat is raised is, again, of benefit to both adults and young children.

As stated, the dimensions of the toilet light are such that it can easily fit between the underside of the toilet seat and the toilet bowl and be adhesed to the underside of the toilet seat and provide a lighting means for the inside of the toilet bowl and allow the toggle switch 60 to be manipulated.

This particular embodiment of the toilet light 10 has been disclosed with respect to a standard AA battery. The toilet light 10 can be equipped with a snap-fit sliding door to permit the ease of replacement of the AA battery. Another embodiment of the invention would include a permanently encased housing having a long term battery encased therein, such that the entire unit could be discarded when the battery is no longer functional and replaced by another complete toilet light unit.

While the present invention has been described in connection with the exemplary embodiment thereof, it will be understood that many modifications will be apparent to those of ordinary skill in the art and that the application is intended to cover any adaptations or variations thereof. Therefore, it is manifestly intended that this invention be only limited by the claims and the equivalents thereof.

I claim:

1. A toilet lighting system in combination with a toilet having a toilet bowl, toilet seat, and toilet cover, said toilet seat and said toilet cover being independently pivotable between a lower position and an upper position in relationship to said toilet bowl, said toilet lighting system comprising:

an L-shaped housing, a portion of which is transparent, said L-shaped housing secured to the underside of said toilet seat thereby positioning said lighting system between said underside of said toilet seat and the rim of said toilet bowl when said toilet seat is in said lower position, one leg of said L-shaped housing extending downwardly inside said toilet;

a lighting means secured in said L-shaped housing in said portion of said L-shaped housing extending downwardly into said toilet bowl;

an electrical source means secured in said housing in connection with said lighting means;

an automatic electrical switching means secured in said housing activating said lighting means when said toilet seat is pivoted to said upper position;

a manual electrical switching means secured in said housing manually activating said lighting means when said toilet seat is positioned in either said lower or upper position.

* * * * *